US005174765A

United States Patent [19]

Williams et al.

[11] Patent Number: 5,174,765

[45] Date of Patent: Dec. 29, 1992

[54] ELECTRICAL CONNECTOR HAVING ELECTRICALLY CONDUCTIVE ELASTOMER COVERED BY INSULATING ELASTOMER

[75] Inventors: Joseph M. Williams; Roger P. Bartel, both of Houston, Tex.

[73] Assignee: Barvid Technology Inc., Houston, Tex.

[21] Appl. No.: 220,996

[22] Filed: Jul. 13, 1988

Related U.S. Application Data

[63] Continuation of Ser. No. 863,013, May 14, 1986, abandoned.

[51] Int. Cl.[5] ..... H01R 13/44

[52] U.S. Cl. ..... 439/86; 439/426; 439/924

[58] Field of Search ..... 339/96, DIG. 3; 439/86, 439/387, 389, 390, 426, 924; 29/863, 865, 866

[56] References Cited

U.S. PATENT DOCUMENTS

| | | | |
|---|---|---|---|
| Re. 11,970 | 2/1902 | Greil et al. | 439/389 |
| 1,067,024 | 7/1913 | Hall et al. | 439/389 |
| 2,439,589 | 4/1948 | Sundell | 173/328 |
| 2,620,029 | 12/1952 | Turzchek et al. | 339/96 |
| 2,677,811 | 5/1954 | Anderson et al. | 339/96 |
| 2,858,518 | 10/1958 | Chrystie et al. | 439/426 |
| 3,127,230 | 3/1964 | Marquis et al. | 339/96 X |
| 3,153,561 | 10/1964 | Cooney | 439/86 |
| 3,158,420 | 11/1964 | Olson et al. | 339/96 |
| 3,596,231 | 7/1971 | Melton | 339/96 |
| 3,848,949 | 11/1974 | Falkner | 439/426 |
| 3,947,959 | 4/1976 | DuRocher | 339/DIG. 3 X |
| 3,976,347 | 8/1976 | Cooke, Sr. et al. | 339/56 X |
| 4,051,456 | 9/1977 | Heilhecker et al. | 340/18 LD |
| 4,113,016 | 9/1978 | Trott | 166/297 |
| 4,119,210 | 10/1978 | Desourdy | 214/1 PA |
| 4,348,672 | 9/1982 | Givler | 340/854 |
| 4,514,481 | 4/1985 | Scozzafava et al. | 430/58 |

*Primary Examiner*—Neil Abrams

[57] ABSTRACT

The connector includes a first connector member that is connected to a first conductor and includes a probe that is inserted through an insulating elastomer into a conductive elastomer which is connected to a second conductor and located in a second connector member. The connection between the probe and the conductive elastomer provides a noise-free electrical connection between the two conductors. The connector is particularly useful in the transmission of data from memories in electronic apparatus. More particularly, the connector is useful in very harsh environments such as in oil and gas wells where the environment may be conductive and it is desired to make a remote connection ot an electronic sensor and transmit the data soted therein to the surface of the well.

3 Claims, 6 Drawing Sheets

ELECTRICAL CONNECTOR HAVING ELECTRICALLY CONDUCTIVE ELASTOMER COVERED BY INSULATING ELASTOMER

This is a continuation of co-pending application Ser. No. 863,013 filed on May 14, 1986, and now abandoned.

BACKGROUND OF THE INVENTION

This invention relates generally to an improved electrical connector for connecting first and second conductors. More particularly, but not by way of limitation, this invention relates to an improved electrical connector that is particularly suited for use in connecting first and second conductors in a remote location in the presence of an electrically conductive environment.

In the logging of oil and gas wells and the like during the process of drilling the well, electronic sensing devices of various types have been located in the drilling string which supports the drill bit used for forming the well bore. The electronic sensors sometimes include means for transmitting the signal up a conductor installed in the drill string or transmitting a signal through the mud system used for lubricating and cooling the bit. In other instances, the electronic sensor has included a memory onto which the data or information sensed by the sensor is recorded. In these instances, the practice has been in the past to recover the sensor and the recorded data by pulling the drill string from the well bore either for that purpose or on the occasion of changing a worn drill bit.

As mentioned above, it has been necessary in the past to pull the drill string from the well in order to obtain the contents of the sensor's memory. Such a procedure is involved, expends a substantial amount of time and effort, and is expensive in terms of lost drilling time. If the memory is not queried except when the drill bit is worn and must be removed from the well, the data recorded is not obtained when desired and thus does not fulfill the ultimate aim of obtaining the information related to the well bore at the earliest possible time after recording.

In an effort to alleviate the foregoing difficulties, it has been proposed to mount the electronic sensing device having a memory in the drill string slightly above the bit. An electrical conductor will then be extended into the well bore, that is, through the drill pipe, and a connection made with the sensor which will provide means for querying the sensor's memory without the necessity for removing the drill string from the well bore.

To further complicate the problem of obtaining the data from the recorder (memory) located in the drill string, it is highly desirable, even if drilling of the well is stopped, to continue circulating "drilling mud" down the interior of the drill pipe and up the annulus between the drill pipe and the well bore wall. Stopping the mud flow for long periods may result in caving of the walls of the well bore and the sticking of the drill pipe therein. Therefore, it is desirable, if not necessary, to continue to circulate the drilling mud through the drill string and upwardly through the annulus as the recorded data is obtained from the sensor.

With the continued circulation of the mud, the remote location of the sensor, extremely high hydrostatic pressures, elevated temperature, the presence of solids, sand, and the conductivity, high viscosity, etc. of the mud, it will be appreciated that difficulty in making a connection with the sensor that is adequate for the transmission of data will be encountered. Manifestly, such a connection must be electrically sufficient so that the data can be transmitted at high frequency therethrough, and yet, must be a connection that can be easily and positively released by pulling up on the conductor even though the sensing device may be located as deep as 20,000 feet or more in the well bore.

As the drilling mud flows through the drill pipe, and due to the nature of the mud pumps utilized for circulating the drilling mud, some surging occurs which causes the conductor to be somewhat unstable as it is lowered into the drill pipe. Even if and after a connection is made, there is a possibility of movement between connector parts in the connection which, when attempting to transmit data, may cause line noises that interfere with or destroy the data transmission. For example, if a mechanical pin is inserted into a socket that has spring loaded contacts, the slight movement of the pin relative to the contacts may generate high frequency noises that are imposed on any signal transmitted over the conductor. Accordingly, it is highly desirable to provide a connector which eliminates the cause of such noises.

An additional difficulty, which has previously been touched on, in constructing a connector for use in well bores is that more often than not, the drilling mud is saline and thus is a conductor. The connector for use in a system used in well bores then must exclude the presence of the conductive drilling mud in order to be able to accurately transmit the data from the sensor.

It is an object of this invention to provide an improved electrical connector that would meet the above criteria. It is a further object of this invention to provide an improved electrical connector that will provide noise-free electrical connection between conductors in a harsh environment which may include liquids at pressures that may be 20,000 psi or higher, temperatures that may be 400° F. or higher, and may contain abrasives flowing at high velocities.

SUMMARY OF THE INVENTION

This invention then provides improved electrical connector connecting first and second conductors that comprises a male connector member having one end arranged for connection with the first conductor and having a second end that includes an elongated, substantially rigid probe. A female connector member may include, for example, a conductive medium that is arranged for connection to the second conductor and has an insulating elastomer covering at least one surface of the conductive elastomer. The arrangement is such that the probe penetrates the insulating elastomer and the conductive elastomer to electrically connect the first and second conductors.

In another aspect of the invention, there is provided an improved electrical connector useful in connection with logging while drilling systems that include a recording sensor near a drill bit in a well drilling string located in a well bore. One connector member has a first end connected to an electrical conductor that extends to electronic apparatus mounted on the surface and has a second end that includes an elongated, substantially rigid probe. A second connector member is mounted on the recording sensor and includes a conductive elastomer electrically connected with the sensor. An insulating elastomer covering the conductive elastomer prevents contact between the conductive elastomer and well drilling fluids. The arrangement is such that the probe penetrates the insulating and conductive elastomers to connect the recording sensor to the electronic apparatus while excluding environmental fluids from the electrical connection.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figures 1, 2:
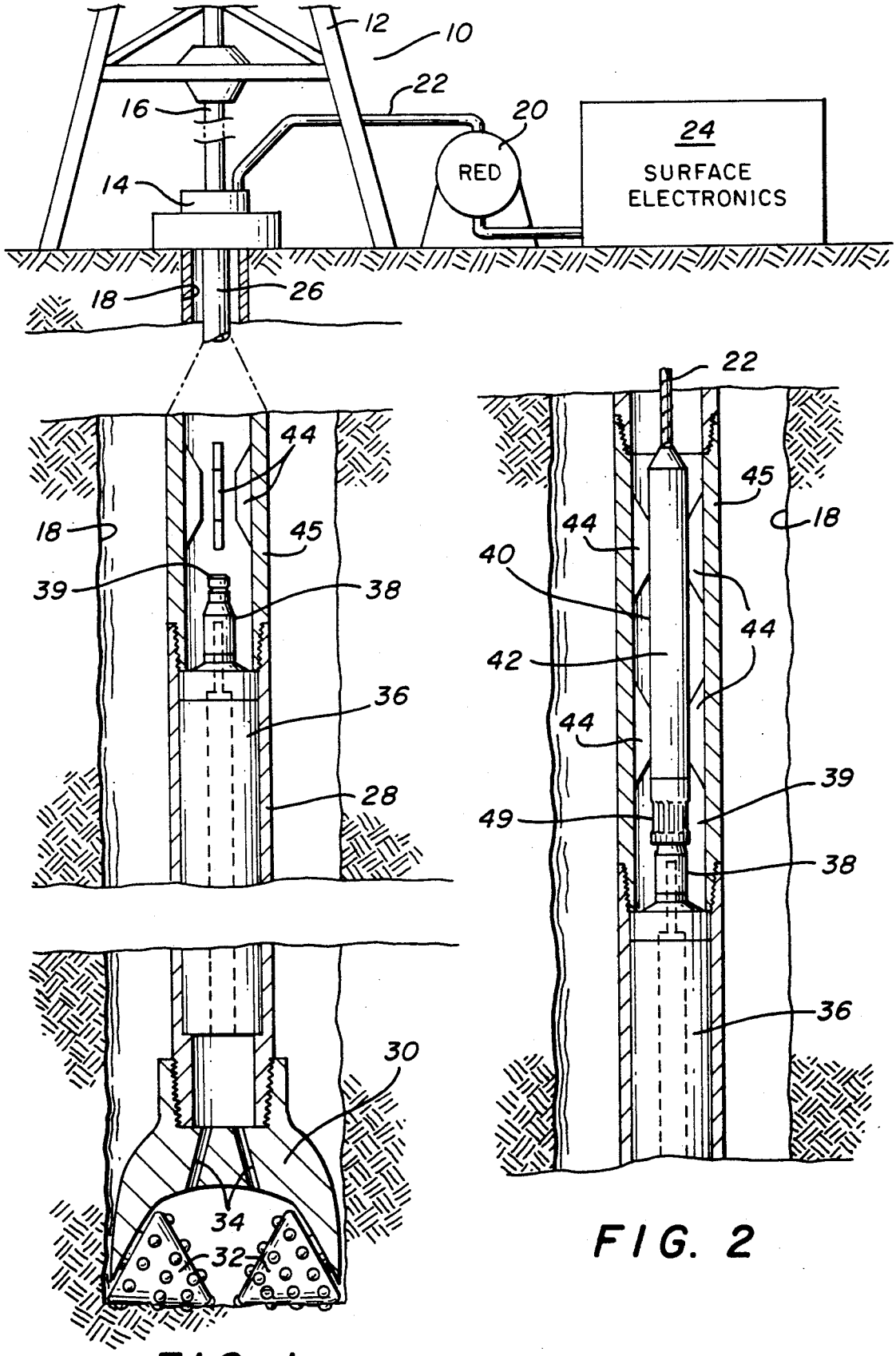
FIG. 1 is a schematic view of a drilling rig having surface electronics and a reel for moving a conductor through a drill string located in a well bore that is shown in cross section. A lower part of the well bore is enlarged to show a recording type sensor located in the drilling pipe in close proximity to a bit.
FIG. 2 is a view of the lower section of the well bore, drill string, and bit of FIG. 1 and illustrating a conductor member that has been extended into the drill pipe and connected with the electronic sensor located in the drill pipe.

Referring to the drawing and to FIG. 1 in particular, shown therein and generally designated by the reference character 10, is a drilling rig that is illustrated schematically. It will, of course, be understood that the drilling rig will be the standard type including a derrick 12, rotary drive system 14, kelly 16 and the other apparatus not shown that is necessary to drill a well bore 18.

Illustrated as being mounted adjacent to the drilling rig 10 at the surface is a reel 20 for handling a conductor 22. Surface electronics 24 are mounted adjacent to the reel 20 and connected therewith as appropriate.

Extending into the well bore 18 is a drill string 26 of the conventional type. The upper end of the drill string 26 is connected to and driven by the rotary table 14. Although not shown, the drill string 26 is generally made up of 30-foot joints of drill pipe which are threadedly connected end to end. The lower end of the drill string 26 includes a plurality of drill collars 28 which are similar to the drill pipe 26, but generally of heavier construction. One or more joints of the drill collars 28 are located between the end of the drill pipe 26 and a drill bit 30. In the usual instance, the drill bit 30 includes three rotating cutters or cones 32 (only two are shown in FIG. 1) and the bit has a plurality of jet passageways 34 that extend therethrough connecting the interior of the drill pipe with the well bore 18.

Mounted in one of the drill collars 28 is a downhole electronic sensor 36 that has a recording memory located therein so that the data sensed by the sensor 36 can be stored. At its upper end, the sensor 36 is provided with a connector member 38 that forms the female half of a connector 39.

The conductor 22 can be seen extending through the drill pipe 26 in FIG. 2. At its lower end, the conductor 22 carries a connector member 40 that is the male half of the connector 39. The connector member 40 includes elongated weighting apparatus 42 for assisting in moving the connector member 40 through the well bore.

Centralizer ribs 44 are located in drill collar 45 for the purpose of centering the connector member 40 in the collars 28 so that the connector member 40 will properly engage and connect with the connector member 38. The apparatus may be centralized by centralizer or guides (not shown) located on the apparatus 42.

Figure 3:
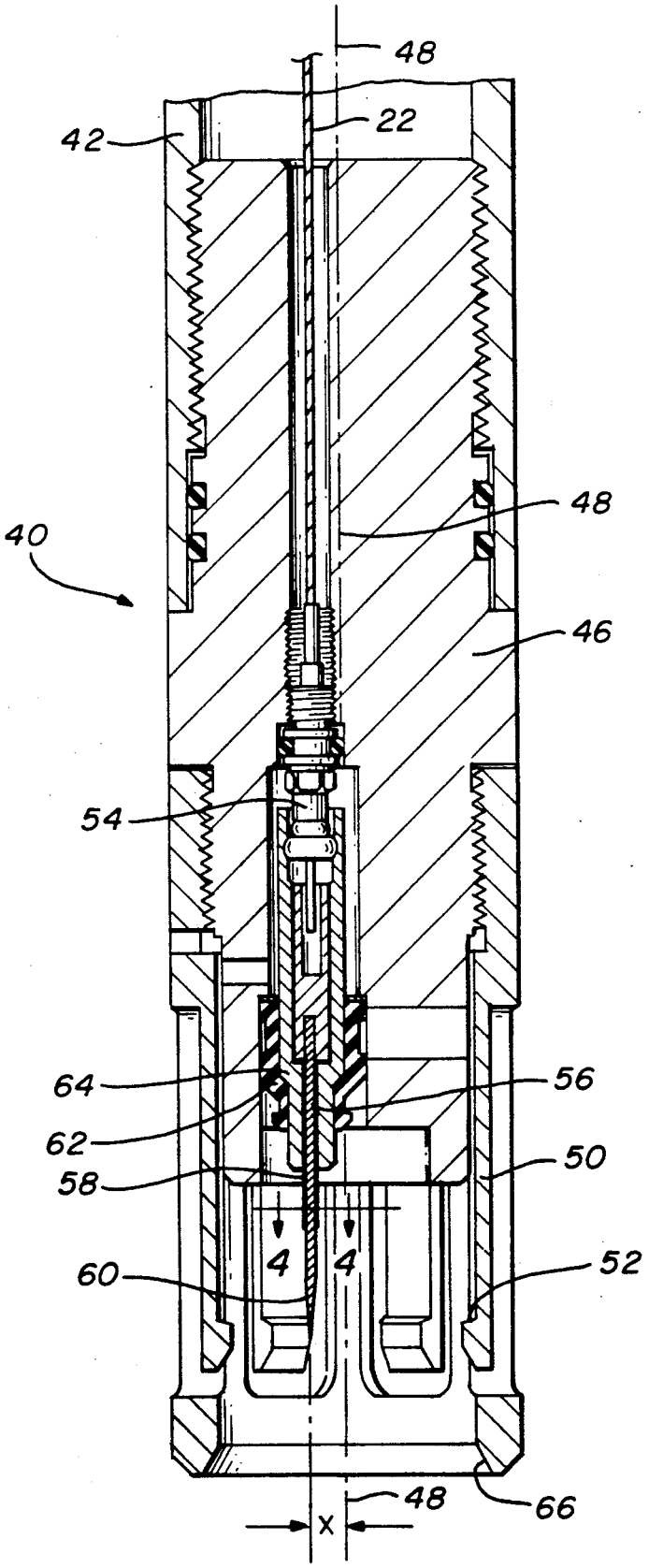
FIG. 3 is a greatly enlarged cross-sectional view of a connector member that is constructed in accordance with the invention and that may be used in the apparatus illustrated in FIGS. 1 and 2.

The connector member 40, as shown in FIG. 3, includes a generally cylindrical body 46 that has an axial centerline 48. Encircling the exterior of the body 46 are a plurality of collet fingers 50 which comprise part of a releaseable latch assembly 49 connecting the connector members 38 and 40 (see FIG. 7). Each of the collet fingers 50 has near its lower end an upwardly facing generally radially disposed surface 52 that function to latch the conductor member 40 to the connector member 38 as will be described. It should be pointed out that the surfaces 52 are angled slightly relative to the centerline 48 for reasons that will be discussed hereinafter.

Near the center of the body 46, a bore is provided through which the conductor 22 extends to a ferrule type coupling 54 which electrically joins the conductor 22 with a substantially rigid, elongated probe 56. The probe 56 need have only sufficient stiffness or rigidity to penetrate the connector as hereinafter described. A certain amount of flexibility is desireable to avoid damage to the probe should twisting or slight misalignment occur. As shown in FIG. 3, the centerline of the probe 56 is offset by a distance X from the centerline 48 of the male half of the connector 40. The centerline of the probe 56 can coincide with the centerline 48, but the offset arrangement is preferred.

Figure 4:
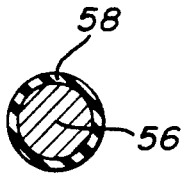
FIG. 4 is an enlarged, transverse cross-sectional view through the probe of the connector of FIG. 3 taken generally along the line 4—4 of FIG. 3.

The probe 56 includes an outer insulating layer 58 (see FIG. 4) that terminates near pointed end 60 of the probe 56. The probe 56 is retained in the coupling 40 by a threaded bushing 62 which, when screwed into the body 46, forces a rubber boot insulator 64 into tight frictional holding engagement with the exterior of the probe 56.

As previously mentioned in connection with the description of FIG. 2, centralizer ribs 44 are provided on the collar 45 to align the connector member 40 with the connector member 38. To further assure that the members 38 and 40 are properly aligned, the interior of the body 46 is provided with a beveled surface or bore 66 that is arranged to mate with a beveled guide portion or surface 68 on the exterior of the connector member 38.

Figure 5:
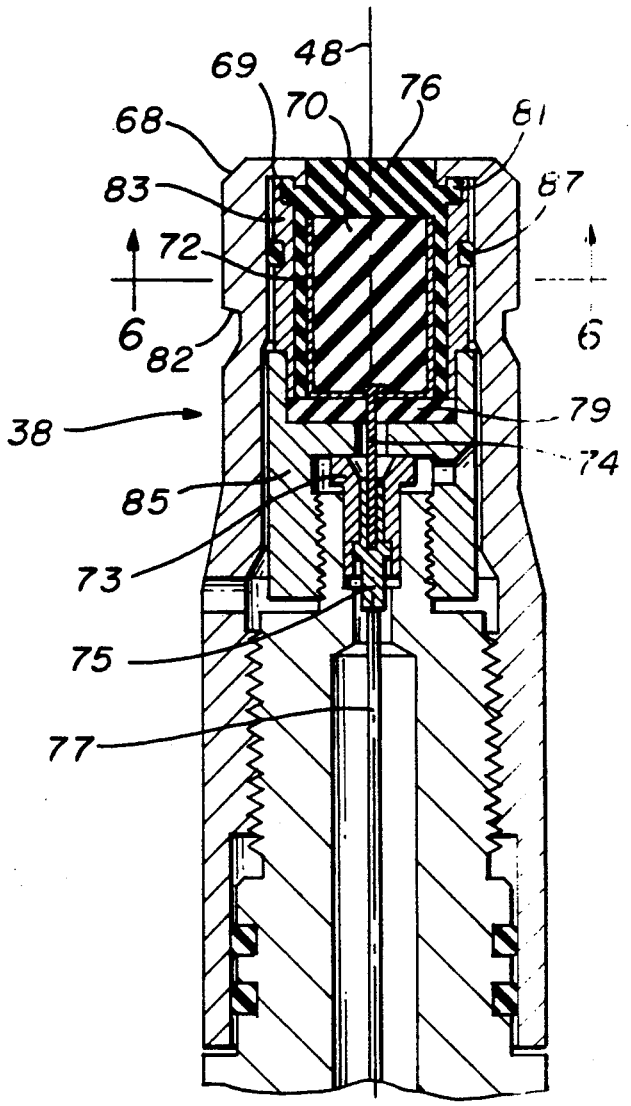
FIG. 5 is a cross-sectional view of the other connector member that is arranged for connection with the connector member shown in FIG. 3.
Figure 6:
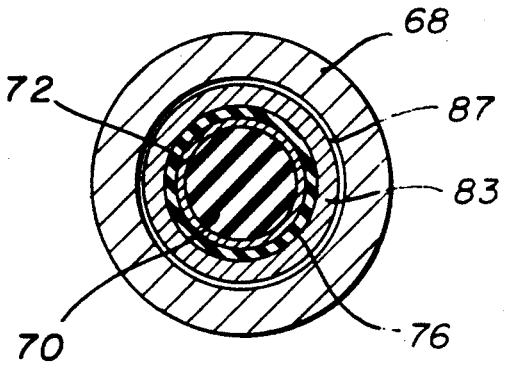
FIG. 6 is an enlarged, transverse cross-sectional view taken generally along the line 6—6 of FIG. 5.

Referring to FIG. 5, the connector member 38, in addition to the beveled guide portion 68, includes in its interior a conductive elastomer 70 that is encased in a cup 72 constructed from a conductive material. The cup 72 is connected at its lower end to a conductor 74 that is connected through cable connector 75 to conductor 77 which extends to the memory of the electronic sensor 36. The cable connector 75 is insulated from connector member 85 by insulating member 73. The upper surface of the conductive elastomer 70 is covered by a layer of insulating elastomer 76. The exterior walls of the conductive cup 72 are covered by a layer of an insulating material which, as illustrated in FIG. 5, may be part of the insulating elastomer 76. The bottom of the conductive cup 72 is electrically insulated by an insulator member 79. The cup 72 may be formed by plating, spraying or otherwise depositing conductive material on the elastomer.

When used in this application, "conductive elastomer" shall mean and include all material that are electrically conductive and have the physical properties of elastomers. The preferred conductive elastomer consists of a matrix of electrically conductive particles suspended in a material exhibiting certain physical properties making the elastomer sufficiently non-compressible, pliable, self-healing, and free from gaseous voids. Within the matrix, the density of the electrically conductive particles is such that the particles are in close proximity to each other creating a conductive network from particle to particle thus making the entire member electrically conductive throughout. Other materials which can be used in place of the conductive particles includes conductive fibers, conductive powders, conductive mesh, conductive wools, conductive foils or films, or conductive fluids.

Also as used in this application, the term "insulating elastomer" is meant to include those materials having electrically insulating characteristics and having the physical characteristics of elastomers. Insulating elastomers shall include materials such as nitrile rubber, silicone rubber, and neoprene.

The term "self-healing" means that the elastomer will close holes perforated therein by the probe and will close around the probe, sealing on the probe and further will close as the probe is withdrawn preventing the passage of environmental materials therethrough.

As illustrated in FIG. 5, the guide portion 68 is threadedly connected to a connector body 78 which, although not shown, is connected at its lower end to the sensor 36. Insulating elastomer 76 contains an annular radial face seal portion 81 which forms a hermetic, high pressure seal with the face 69 in the interior of guide portion 68.

With guide portion 68 threadedly connected to connector body 78, the downward facing radial face 69 of guide portion 68 engages the top end of connector sleeve 83 forcing the lower end of the connector sleeve 83 against insulator member 79. The member 79 is supported by connector member 85. Compressive load is applied by threading the connector body 78 into the guide portion 68 forcing the connector sleeve 83 into intimate contact on its top end with guide member face 69 and on its bottom end with the insulator member 79. This relationship of intimate contact is maintained during the use of the connector 39 to provide a zero-clearance seal arrangement which prevents the insulating elastomer 76 from extruding during high pressure application.

A back-up seal 87, of standard type, is provided on connector sleeve 83 to assure pressure integrity with the guide portion 68. Additional seals 91 and 92 of standard type are provided on connector body 78 which prevent leakage between the other end of guide portion 68 and the connector body 78 when threadedly connected to connector body 78.

The medial portion of the guide portion 68 is provided with a downwardly facing annular surface 82 that is arranged to be engaged by the upwardly facing surfaces 52 on the collet fingers 50. As illustrated in FIG. 5, surface 82 may not be precisely perpendicular to the longitudinal axis 48 of the connector. The angle therebetween is designed to permit the collet fingers 50 to spring outwardly and out of engagement with the connector member 38 when an upward pull of a predetermined value is taken on the conductor 22. The angle can be calculated to provide a precise amount of force for the separation of the connector members 38 and 40.

OPERATION OF THE PREFERRED EMBODIMENT

The operation of the connector 39 will be described in conjunction with the system for the logging while drilling apparatus. Initially, the electronic sensor 36 is mounted in the drill collars 28 as illustrated in FIG. 1. It will be noted therein that the conductor 22 does not extend into the drill string 26. Normal drilling operations take place with the sensor 36 preserving the data sensed thereby in the memory thereof.

When it is desired to obtain the recorded data, the reel 20 is actuated to lower the conductor 22 into the drill string 26. The centralizer ribs 44 in the collar 45 and the weighting member 42 locate the collet fingers 50 in a position wherein they engage the guide portion 68 of the connector member 38 of the connector 39. The collet fingers 50 spread outwardly and spring inwardly after the surfaces 52 have passed the surface 82 and latching engagement is attained. When this has been accomplished, the apparatus will be in the approximate position illustrated by FIG. 2. Also, it will be noted that the latch assembly 49 will be in the position illustrated in the enlarged, fragmentary cross-sectional view of FIG. 7.

To be certain that the latch assembly has latched, an upward pull is taken on the conductor 22 applying a force to the connector member 40 of the connector 39 that is just below the design separation force. If this force can be applied to the conductor 22 by the reel 20, then it is known that the connector 39 is in fact connected.

After it has been ascertained that the proper connection has been made, it is known that the probe 58 has penetrated the insulating elastomer 76 and entered into the conductive elastomer 70. A signal is then transmitted down the conductor 22 activating the sensor 36 and transmitting the data stored in the memory thereof through the connector 39 and conductor 22 to the surface electronics 24.

Figure 7:
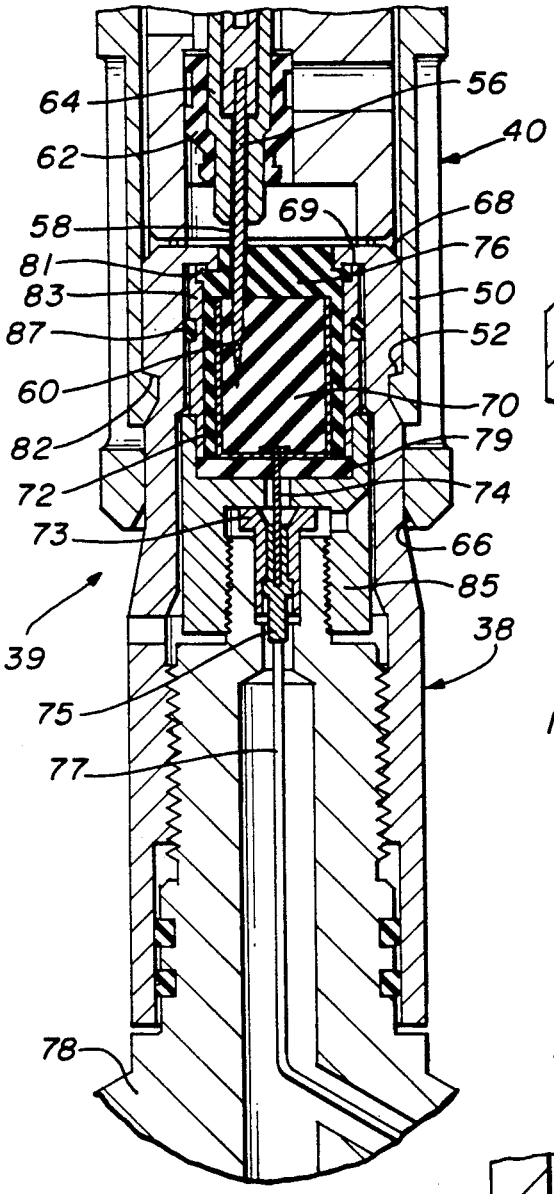
FIG. 7 is a cross-sectional view illustrating the assembly of the connector parts shown in FIGS. 3 and 4.

Even though there may be conductive fluid (drilling mud) in the drill string 26, it will be noted in FIG. 7 that the probe 56 and the insulating portion 58 thereon have passed through the insulated elastomer 76 with the uninsulated portion 60 of the probe 56 being disposed in the conductive elastomer 70. As previously mentioned, the insulating elastomer 76 is self-healing and forms a seal with the probe 56 as it passes therethrough, thus cleaning the probe 56 and excluding any deleterious materials that may be located within the connector 39.

It should also be pointed out that the resilient nature of the conductive elastomer 70 is such that a constant force is exerted on the uninsulated portion 60 of the probe 56 so that slight movement thereof does not affect the electrical contact between the probe 58 and the conductive elastomer 70, and thus, there are no high frequency noises generated as is true when movement occurs between a metallic probe and a spring loaded mechanical socket.

The offset nature of the probe 56 permits the connection, disconnection and reconnection of the connector 39 many, many times without damaging the insulating elastomer 76 or the conductive elastomer 70 since the probe 58 enters and passes therethrough at random circumferential positions located on the offset radius.

Figure 8:
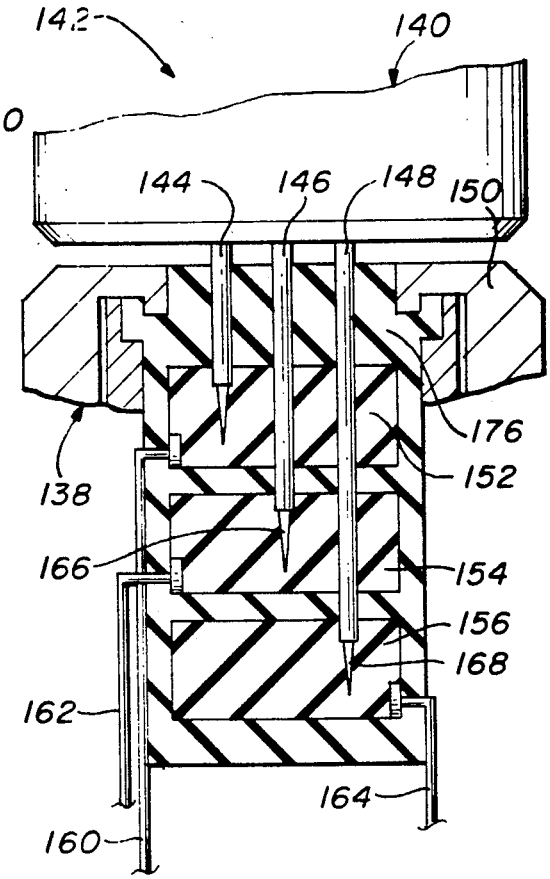
FIG. 8 is an enlarged, partial cross-sectional view illustrating one type of multipin connector that is also constructed in accordance with the invention.

Description of the Embodiment of FIG. 8

FIG. 8 is a fragmentary cross-sectional view illustrating a multiprobe connector that is constructed in accordance with the invention. As shown therein, the connector member 150 of the multiprobe connector 142 includes probes 144, 146 and 148, each of which is a different length. A connector member 138 of the connector 142 includes a beveled guide portion 150 in which there is located an insulating elastomer 176.

It will be noted that the insulating elastomer 176 is elongated as compared to the insulating elastomer 76 in the embodiment of FIG. 5. The elongation thereof is provided so that three separate conductive elastomer layers 152, 154 and 156, respectively, are located therein. It will be noted that layers of the insulating elastomer 176 completely encapsulates the conductive elastomer layers 152, 154 and 156. Conductors 160, 162 and 164 extend, respectively, from the conductive elastomers 152, 154 and 156. Although not shown, conductors will also extend from communication with the probes 144, 146 and 148 to the surface or to other electronic apparatus.

As shown, the shorter of the probes, 144, extends only into the conductive elastomer 152. The medium length probe 146 is insulated for a sufficient part of its length so that the insulation extends through the conductive elastomer 152 and uninsulated portion 166 thereon is disposed in the conductive elastomer 154.

Similarly, the probe 148 has sufficient length and insulation thereon to pass through the conductive elastomers 152 and 154 and uninsulated portion 168 thereon is disposed in the layer of conductive elastomer 156. Thus, electrical connection is made from the conductors (not shown) extending to the surface with each of the conductors 160, 162 and 164.

It should be also pointed out that the layers of conductive elastomer 152, 154 and 156 are preferably formed as discs so that orientation of the connector member 140 of the connector 142 is not required. While a three probe connector is illustrated, it will be understood that any number of probes can be incorporated within the physical limitations of such apparatus. Also, it should be pointed out that the connector operates precisely as previously described.

Figure 9:
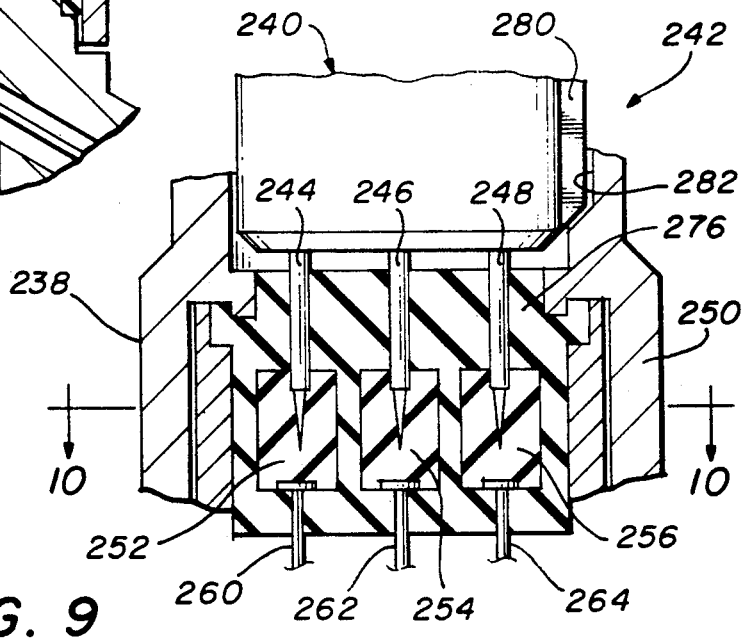
FIG. 9 is view similar to FIG. 8, but illustrating another embodiment of multipin connector that is also constructed in accordance with the invention.

The Embodiment of FIG. 9

The enlarged fragmentary cross-sectional view of FIG. 9 illustrates another embodiment of multiprobe connector that is also constructed in accordance with the invention. The connector member 240 is illustrated as being connected with the connector member 238 forming the connector 242.

As illustrated, the connector member 240 includes equal length probes 244, 246 and 248. It should be understood that as many of the probes as desired and that can be physically arranged on the connector 242 may be utilized.

Figure 10:
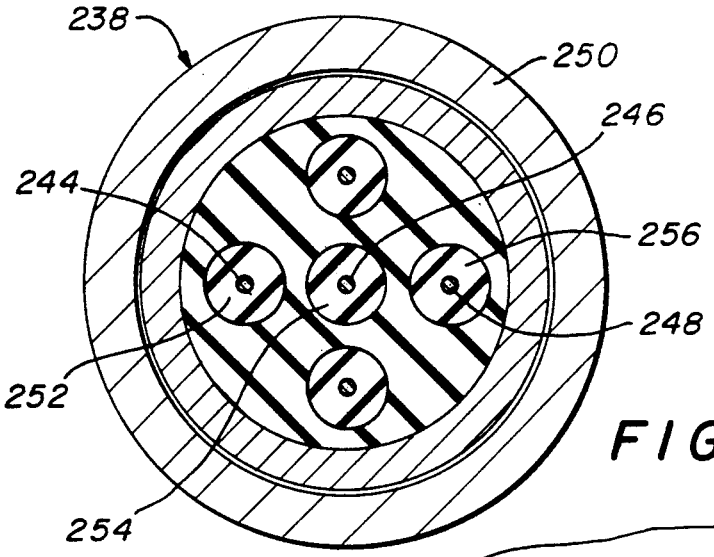
FIG. 10 is a transverse cross-sectional view taken generally along the line 10—10 of FIG. 9.

The probes each extend through an insulating elastomer 276 which encapsulates a plurality of discreet conductive elastomer plugs 252, 254 and 256. Each of the conductive elastomer plugs is in communication with a respective conductor 260, 262, and 264 and they are electrically insulated from each other by an insulator member which, as illustrated in FIG. 9, may be part of the insulating elastomer 276. In the transverse cross-sectional view of FIG. 10, the plugs (more than three are shown) are illustrated as being arranged circumferentially. They may be arranged in any desired manner.

Although not illustrated, it will be understood that the probes 244, 246 and 248 are connected to respective conductors leading from the connector member 240. To maintain the probes in mating alignment with the conductive elastomer plugs, the connector member 240 is provided with a key 280 which fits into a mating groove 282 formed in the upper end of the connector member 250.

As illustrated, the connector member 238 also includes a conical portion for guiding the connector together in the event it is used in a remote location. Although each of these connectors has been illustrated as including the guide portion, it will be understood that such guide portion may not be necessary unless the connector is used in a remote location.

Figure 11:
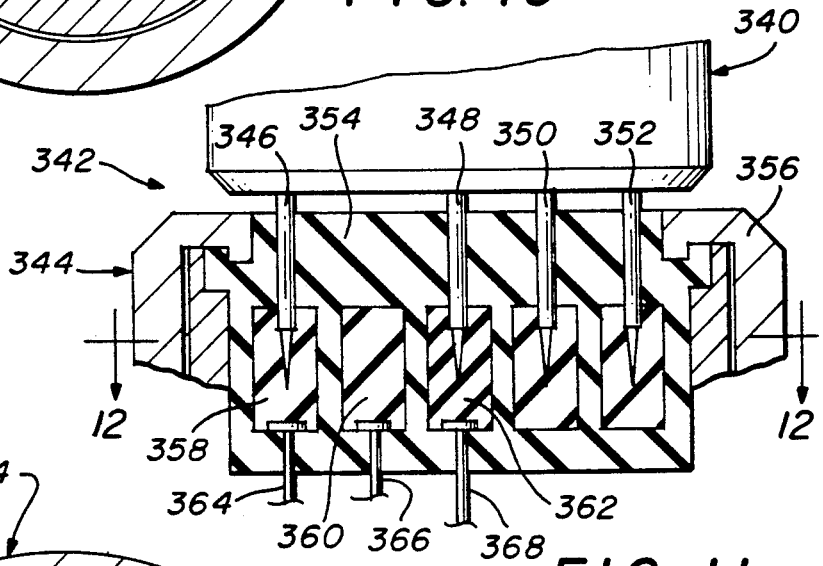
FIG. 11 is a view similar to FIG. 9, but illustrating another embodiment of connector that is also constructed in accordance with the invention.
Figure 12:
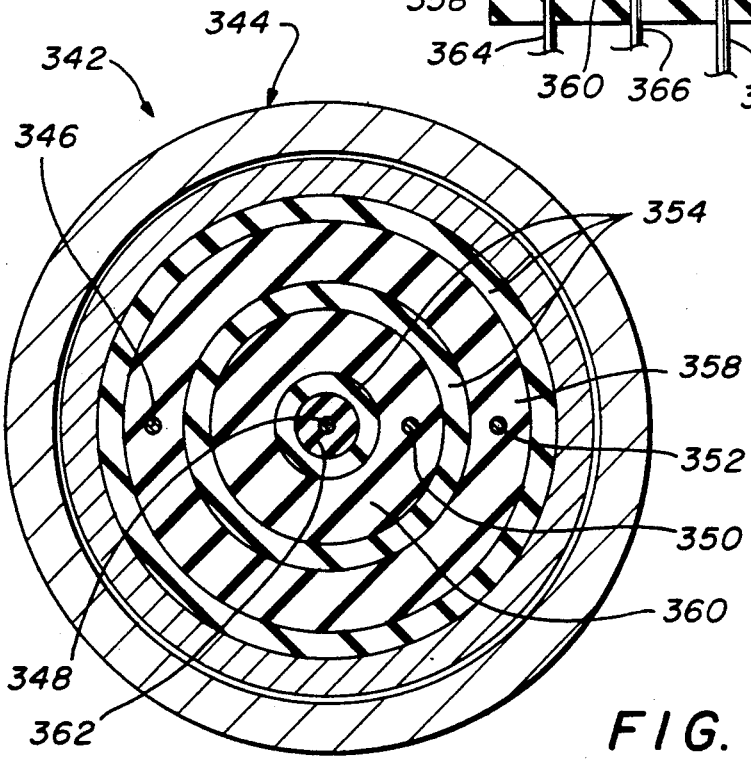
FIG. 12 is a transverse cross-sectional view taken generally along the line 12—12 of FIG. 11.

The Embodiment of FIG. 11

FIG. 11 illustrates, partly in cross-section and partly in elevation, another embodiment of multi-pin connector that is designated generally by the reference character 340. The connector 340 includes a male connector 342 and a female connector member 344. The male connector member 342 includes a plurality of conductive probes or pins 346, 348, 350 and 352. It will be noted that each of the pins includes an insulated sleeve portion leaving the tips of the pins exposed.

When connected with the female connector member 344, the pins each penetrate an insulating elastomer 354 that is secured in a guide portion 356 of the female connector member 344. Separated by concentrically arranged insulators, which, as illustrated in FIG. 11, may be part of the insulating elastomer 354, are concentrically arranged conductive elastomers 358, 360 and 362. As many concentric rings as desired can be provided, and of course, each is located to receive one or more of the probes mounted in the male connector member 342. Through the conductive elastomer, an electrical circuit is completed from the pins through a conductor 364 that is in electrical communication with the conductive elastomer ring 358, conductor 366 which is in electrical communication with the conductive elastomer ring 360, and electrical conductor 368 which is in electrical communication with the centrally located conductive elastomer 362.

It will be noted in FIG. 11 that probes 346 and 352 extend into the conductive elastomer ring 358 while the probe 348 extends into the conductive elastomer 362 and the probe 350 extends into the ring 360. The illustration shows that the connector 340 can have more than one probe in each conductive elastomer ring if needed.

The pins or probes are illustrated as being in a single line extending across the connector 340. Manifestly, the pins can be arranged as desired with the only requirement being that the appropriate pin is located in the desired one of the conductive elastomer portions. With this arrangement, no key is needed with the multipin connector 340 since the use of concentric rings of conductive elastomer eliminates the need for orientation.

Figure 13:
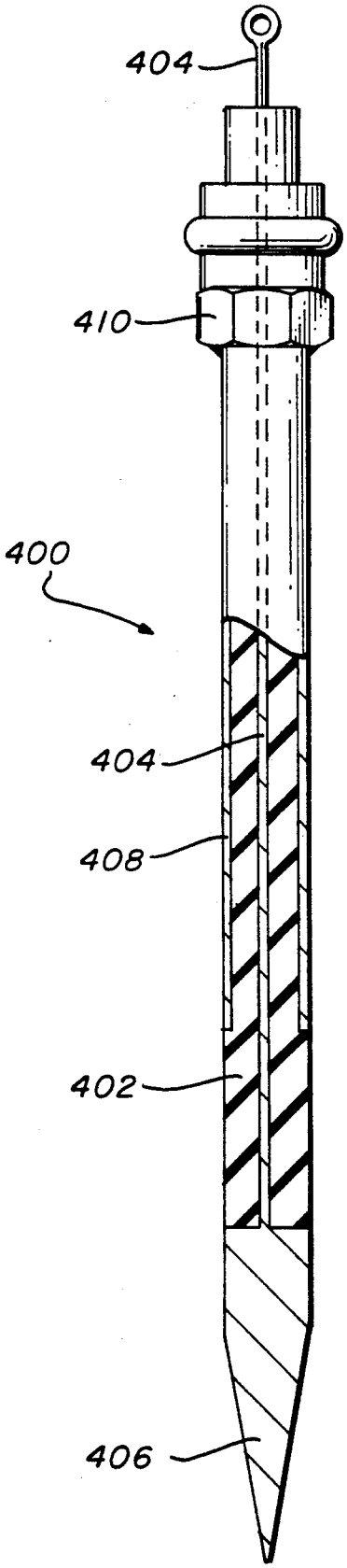
FIG. 13 is an enlarged, cross-sectional view of another probe that can be used in the connector of FIG. 3.
Figure 14:
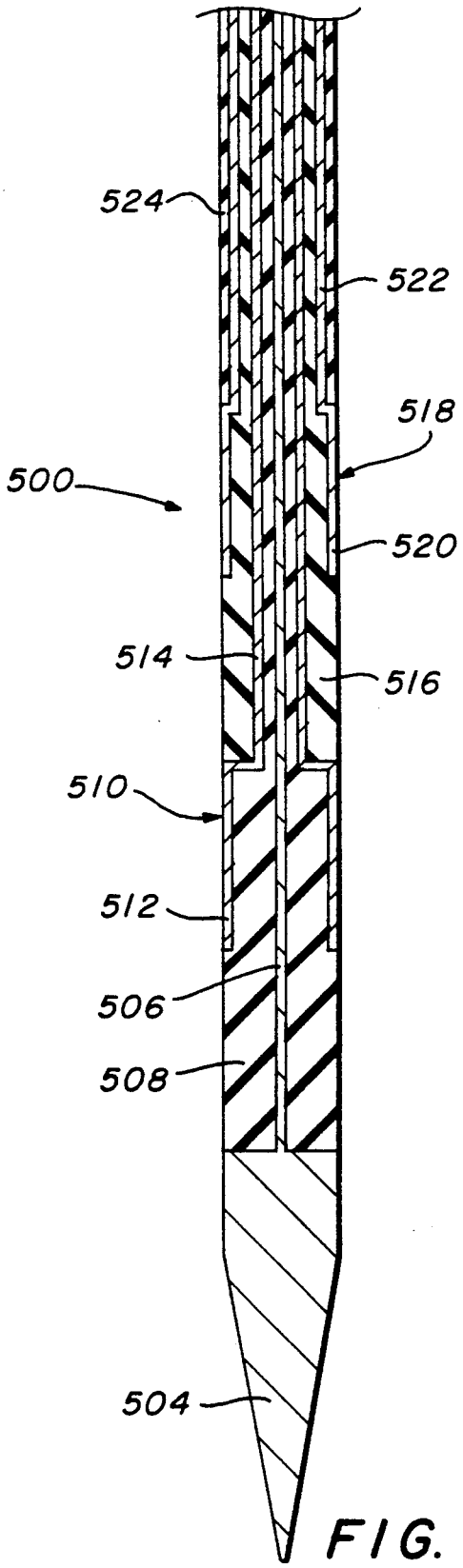
FIG. 14 is an enlarged, cross-sectional view of another probe that can be used in the connector of FIG. 8.

The Probe Modifications of FIGS. 13 and 14

FIG. 13 illustrates a modified form of probe or pin that can be utilized in the connectors utilized hereinbefore. The pin of FIG. 13 is generally designated by the reference character 400. As illustrated, the pin 400 includes an elongated generally cylindrical body 402 that is constructed from an insulating material. The body 402 is hollow and has a conductor 404 extending therethrough.

The conductor 404 has one end connected to a probe tip 406 that is constructed from a conductive material and is pointed as illustrated for the purpose of penetrating the insulating and conductive elastomers, as previously described. The other end is connected to an appropriate head for location in the desired connector.

To add stiffness to the insulating material 402, the exterior of the body 402 is provided with a metal sheath 408 which extends from an end 410 of the probe 400 toward the tip 406. It will be noted, however, that the sheath 408 does not touch the tip 406, nor does it touch the conductor 404. The sheath 408 may permit use of the probe in environments wherein a probe with only an insulating sheath could not be used.

FIG. 14 illustrates a multiple contact probe that is generally designated by the reference character 500. The multiple contact probe of FIG. 14 could be used in connection with a connector such as the connector 142 shown in FIG. 8.

The probe 500 includes a body 502 having a tip 504 thereon. The tip is constructed from an electrically conductive material and is pointed so that it will penetrate the insulating and conductive elastomers illustrated in the connectors. The tip 504 is connected with a conductor 506 that extends entirely through the probe 500. Surrounding the conductor 506 is a first body portion 508 from from an insulating material.

A second contact 510 is generally tubular in configuration and has an enlarged end 512 encircling a portion of the insulating material 508. The contact 510 has a reduced diameter portion 514 which extends through the remainder of the probe 500. The reduced diameter portion 514 is surrounded by an insulating material 516.

Concentrically arranged with respect to the conductor 506 and the reduced diameter portion 514 of the contact 510 is a third contact 518 which includes an enlarged diameter portion 520 that encircles the insulating material 516 and a reduced diameter portion 522 that extends through the probe 500. The reduced diameter portion 522 is encircled by an insulating sheath 524.

Although not illustrated, it will be understood that the pin 500 includes a head portion wherein the conductor 506, the reduced diameter portion 512 of the contact 510 and the reduced diameter portion 522 of the contact 518 will each be connected with a separate conductor. Thus, the probe 500 provides a multiple contact pin in a single probe.

As can be seen in each of the foregoing examples, the connectors described in detail provide a noise-free connection in either single or multiple circuit arrangements and provide a connector that can be used in a hostile environment. The insulating elastomer cleans the probes and heals or reseals itself to prevent the entrance of deleterious materials into the conductive elastomer.

From the foregoing detailed description, it will be apparent that many changes and modifications can be made thereto without departing from the spirit or scope of the invention.

What is claimed is:

1. In an improved electrical connector for electrically connecting first and second conductors, the improvement comprising:

a male connector member having one end arranged for connected with the first conductor and having a second end including an elongated, substantially rigid probe; and a female connector member including a conductive elastomer arranged for connected to the second conductor and having an insulating elastomer covering at least one surface of said conductive elastomer, whereby said probe penetrates said insulating elastomer and said conductive elastomer to electrically connected the first and second conductors, said female connector member also including:

a hollow body member having an open first end adjacent to said male connector member;

said insulating elastomer located in said body member having a hollow interior and extending across aid open end extending toward the other end of said body member;

said conducting elastomer being located in said insulating elastomer;

a conductive member in engagement with said end of said conductive elastomer not cover by said insulating elastomer;

said conductive member being connected to said second conductor;

an insulating member located adjacent to said conductive member;

a sleeve located in said body member preventing said deformation of said elastomers; and, means connected with the other end of said housing member for supporting said elastomers against deformation and for exerting a compressive force thereon to seal said insulating elastomer with said housing member.

2. The electrical connector of claim 1 and also including releaseable connection means for holding said probe in said conductive elastomer.

3. The electrical connector of claim 1 wherein said connector members have an axial centerline and said probe is located in generally parallel offset relation to said centerline.

* * * * *

UNITED STATES PATENT AND TRADEMARK OFFICE

CERTIFICATE OF CORRECTION

PATENT NO. : 5,174,765

DATED : December 29, 1992

INVENTOR(S) : Williams et al.

It is certified that error appears in the above-identified patent and that said Letters Patent is hereby corrected as shown below:

In Column 10, line 24, (Claim 1) change "connected" to --connection--.

In Column 10, line 28, (Claim 1) change "connected" to --connection--.

In Column 10, line 33, (Claim 1) change "connected" to --connect--.

In Column 10, line 38, (Claim 1) change "aid" to --said--.

Signed and Sealed this

Sixteenth Day of November, 1993

*Attest:*

Bruce Lehman

BRUCE LEHMAN

*Attesting Officer*

*Commissioner of Patents and Trademarks*